US010851607B1

(12) United States Patent
Cavanagh

(10) Patent No.: US 10,851,607 B1
(45) Date of Patent: Dec. 1, 2020

(54) ROTATING HANGER SYSTEM WITH RATCHET MECHANISM

(71) Applicant: Cameron International Corporation, Houston, TX (US)

(72) Inventor: James Cavanagh, Houston, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 16/416,272

(22) Filed: May 20, 2019

(51) Int. Cl.
*E21B 23/02* (2006.01)
*E21B 23/03* (2006.01)
*E21B 33/04* (2006.01)

(52) U.S. Cl.
CPC ..... *E21B 33/04* (2013.01); *E21B 23/02* (2013.01); *E21B 23/03* (2013.01); *E21B 2200/01* (2020.05)

(58) Field of Classification Search
CPC ..... E21B 23/02; E21B 23/03; E21B 33/04
See application file for complete search history.

(56) References Cited

U.S. PATENT DOCUMENTS 3,713,481 A * 1/1973 Webb ..... E21B 4/10 166/55
8,171,996 B2 * 5/2012 Jennings ..... E21B 33/04 166/208
8,776,892 B2 * 7/2014 Fern ..... E21B 33/0415 166/345
8,955,594 B2 * 2/2015 Bell ..... E21B 33/043 166/341
9,689,229 B2 6/2017 Hanson et al.
9,863,205 B2 1/2018 Levert, Jr. et al.
9,909,385 B2 3/2018 Cocker, III et al.
10,240,439 B2 * 3/2019 Noffke ..... E21B 17/046
10,648,243 B1 * 5/2020 Burrows ..... E21B 17/08
2015/0330156 A1 * 11/2015 Barannikow ..... E21B 17/05 166/377
2015/0345242 A1 * 12/2015 Fernandes ..... E21B 23/01 166/208
2017/0167218 A1 * 6/2017 Cheah ..... E21B 23/02

* cited by examiner

*Primary Examiner* — Matthew R Buck
(74) *Attorney, Agent, or Firm* — Michael L. Flynn

(57) ABSTRACT

A technique facilitates deployment and operation of a casing hanger. A ratchet mechanism may be positioned between the casing hanger and a running tool. The ratchet mechanism may comprise a center body section located between a first cam, e.g. a lower cam, and a second cam, e.g. an upper cam. The first cam is constructed for releasable engagement with the casing hanger and the second cam is constructed for engagement with the running tool. The first cam has a cam profile which causes rotation of the casing hanger when the running tool is rotated in a first direction and which causes the ratchet mechanism to release from the casing hanger when the running tool is rotated in a second direction. Additionally, the second cam also may have a cam profile configured to force the ratchet mechanism toward the casing hanger when the running tool is rotated in the first direction.

19 Claims, 3 Drawing Sheets

ROTATING HANGER SYSTEM WITH RATCHET MECHANISM

BACKGROUND

Hydrocarbon fluids such as oil and natural gas are obtained from a subterranean geologic formation, referred to as a reservoir, by drilling a well that penetrates the hydrocarbon-bearing geologic formation. In many applications, a casing hanger is used to suspend casing in a wellbore. The casing hanger may be deployed into a well by a corresponding running tool. Once the casing hanger is properly positioned, the running tool may be released and retrieved to the surface. In some applications, it can be useful to rotate the casing hanger with the running tool. However, the rotation can create difficulties with respect to releasing the running tool from the casing hanger.

SUMMARY

In general, a system and methodology facilitate deployment and operation of a casing hanger which may be used for hanging various types of casing/tubing. According to an embodiment, a ratchet mechanism is positioned between the casing hanger and a running tool. The ratchet mechanism comprises a center body section which may be located between a first cam, e.g. a lower cam, and a second cam, e.g. an upper cam. The first cam is constructed for releasable engagement with the casing hanger and the second cam is constructed for engagement with the running tool. The first cam has a cam profile which causes rotation of the casing hanger when the running tool is rotated in a first direction and which causes the ratchet mechanism to release from the casing hanger when the running tool is rotated in a second direction. In this embodiment, the second cam also has a cam profile configured to force the ratchet mechanism toward the casing hanger when the running tool is rotated in the first direction.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
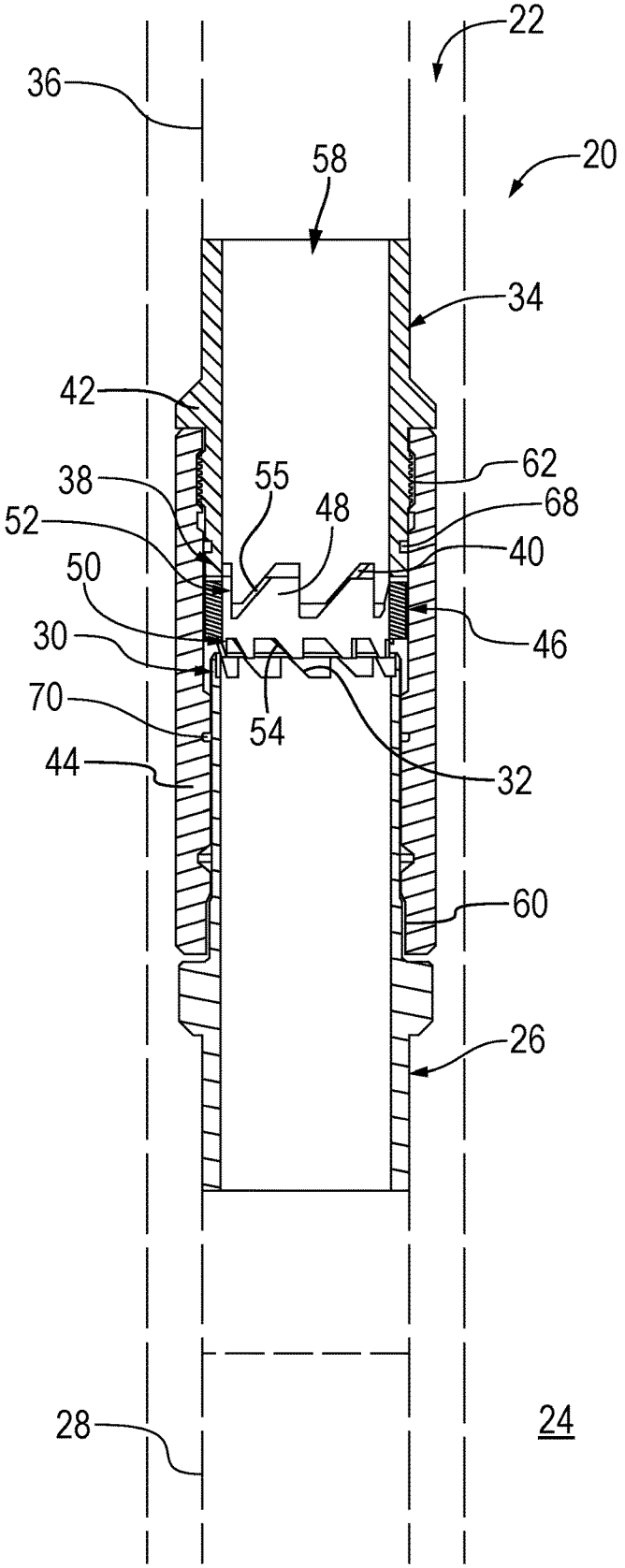
FIG. 1 is an illustration of an example of a well system deployed in a borehole and having a ratchet mechanism positioned between a running tool and a casing hanger, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate deployment and operation of a casing hanger. The casing hanger may be employed to suspend casing and/or various types of tubular members in a borehole, e.g. a wellbore. As described in greater detail below, the casing hanger is a rotatable hanger which can be used to rotate the suspended casing in addition to the casing hanger. In some well operations, rotation of the casing hanger (as well as the suspended casing) may be beneficial to optimizing the well operation. A running tool may be used to deploy and to rotate the casing hanger.

According to an embodiment, a ratchet mechanism is positioned between the casing hanger and the running tool. The ratchet mechanism comprises a center body section which may be located between a first cam and a second cam. By way of example, the first cam is a lower cam and the second cam is an upper cam when the casing hanger is used in a generally vertical wellbore section. The first cam is constructed for releasable engagement with the casing hanger and the second cam is constructed for engagement with the running tool.

The first cam may be formed with a cam profile which causes rotation of the casing hanger when the running tool is rotated in a first direction. However, the first cam profile causes the ratchet mechanism to release from the casing hanger when the running tool is rotated in a second direction. In this embodiment, the second cam may have a cam profile configured to force the ratchet mechanism toward the casing hanger when the running tool is rotated in the first direction.

In other words, when the running tool and casing hanger are rotated in the first direction, the upper cam may be used to create a downward force so as to maintain engagement between the lower cam and the casing hanger. As a result, engagement of the running tool with the casing hanger is ensured and maintained during rotation in the first direction. The same upper cam and lower cam may utilize suitable cam profiles to provide for free rotation of the running tool with respect to the casing hanger in the opposite direction. The free rotation is enabled by the cam profiles which cause the ratchet mechanism to ride up out of engagement with the casing hanger when the running tool is rotated in the second direction. The double ratchet action of the ratchet mechanism ensures easy release of the running tool following use of the running tool for rotating the casing hanger in the first direction. The construction of the ratchet mechanism also helps to reduce the number of pieces/components otherwise employed to enable the desired rotation of a casing hanger.

Referring generally to FIG. 1, an example of a well system 20 is illustrated as deployed in a borehole 22, e.g. a wellbore, drilled into a subterranean formation 24. In the embodiment illustrated, the well system 20 comprises a casing hanger 26 which may be used to suspend and rotate casing 28 and/or other types of tubular members. In some embodiments, the rotatable casing hanger 26 may be employed for hanging other types of tubular members, e.g. tubing, and casing 28 may be in the form of other types of pipe/tubing. In the illustrated example, the casing hanger 26 comprises a casing hanger cam 30 having a desired casing hanger cam profile 32.

The well system 20 also comprises a running tool 34 which may be part of a running tool string 36. The running tool 34 is releasably coupled with the casing hanger 26 to enable deployment and rotation of the casing hanger 26. For example, the running tool 34 may be used to deploy the casing hanger 26 into borehole 22; to rotate the casing hanger 26 during a well operation; and then to release the casing hanger 26 so the running tool 34 may be retrieved to a surface location. The running tool 34 may have a variety of configurations. In the illustrated example, however, the running tool 34 comprises a running tool cam 38 having a desired running tool cam profile 40. In some embodiments, the running tool 34 may be constructed with an inner portion 42 and an outer portion 44. By way of example, the running tool cam 38 and running tool cam profile 40 may be part of the inner portion 42 as illustrated.

Additionally, the well system 20 comprises a ratchet mechanism 46 positioned between the running tool 34 and the casing hanger 26. According to an embodiment, the ratchet mechanism 46 may comprise a central body portion 48, a lower cam 50 extending from the central body portion 48, and an upper cam 52 extending from the central body portion 48 opposite the lower cam 50. The lower cam 50 is oriented for releasable engagement with the casing hanger 26 at casing hanger cam 30. As illustrated, the lower cam 50 also has a lower cam profile 54 which is configured to cause engagement with and rotation of the casing hanger 26 when the running tool 34 is rotated in a first direction. The shape of the lower cam profile 54 also causes the ratchet mechanism 46 to release from the casing hanger 26 when the running tool 34 is rotated in a second or opposite direction.

The upper cam 52 is oriented for engagement with the running tool 34 at running tool cam 38. Additionally, the upper cam 52 may have an upper cam profile 56 which is configured to force the ratchet mechanism 46 toward the casing hanger 26 when the running tool 34 is rotated in the first direction. When the running tool is rotated in the second direction, the configuration of the upper cam profile 56 forces rotation of the ratchet mechanism 46 in this second direction.

As the ratchet mechanism 46 is rotated in the second direction, the lower cam profile 54 interacts with the casing hanger cam profile 32 in a manner which drives the ratchet mechanism 46 away from the casing hanger 26, thus releasing engagement with the casing hanger 26. It should be noted the casing hanger 26, running tool 34, and ratchet mechanism 46 may be formed as generally tubular members having an internal passage 58 which allows flow of fluid therethrough.

Figure 2:
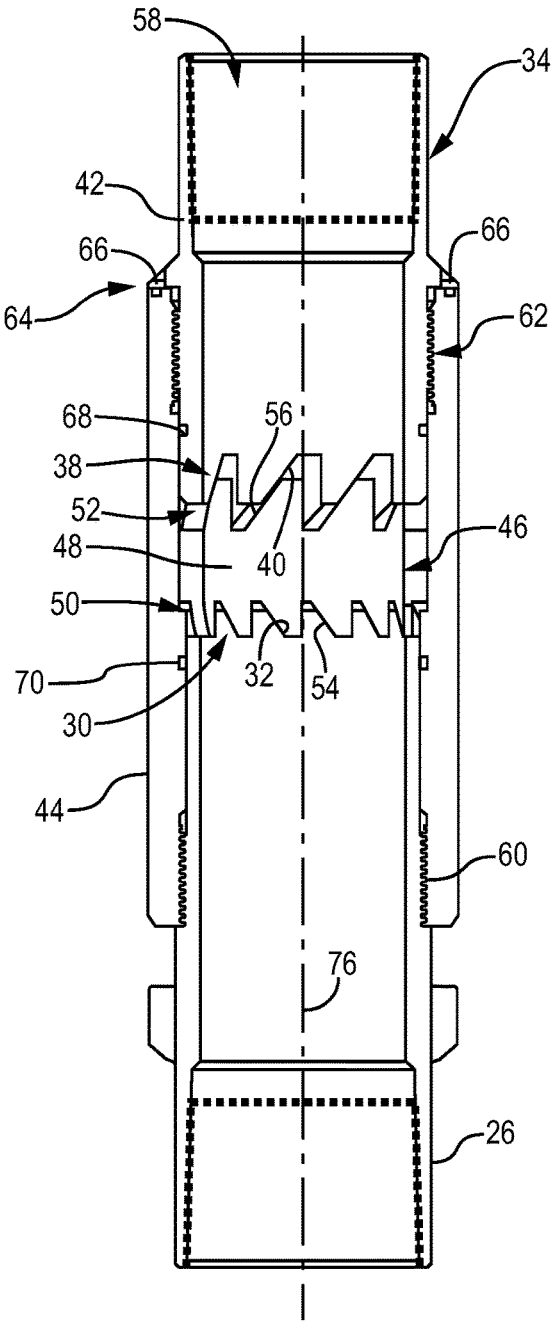
FIG. 2 is an illustration of an example of a ratchet mechanism positioned between a running tool and a casing hanger during rotation of the casing hanger, according to an embodiment of the disclosure.
Figure 3:
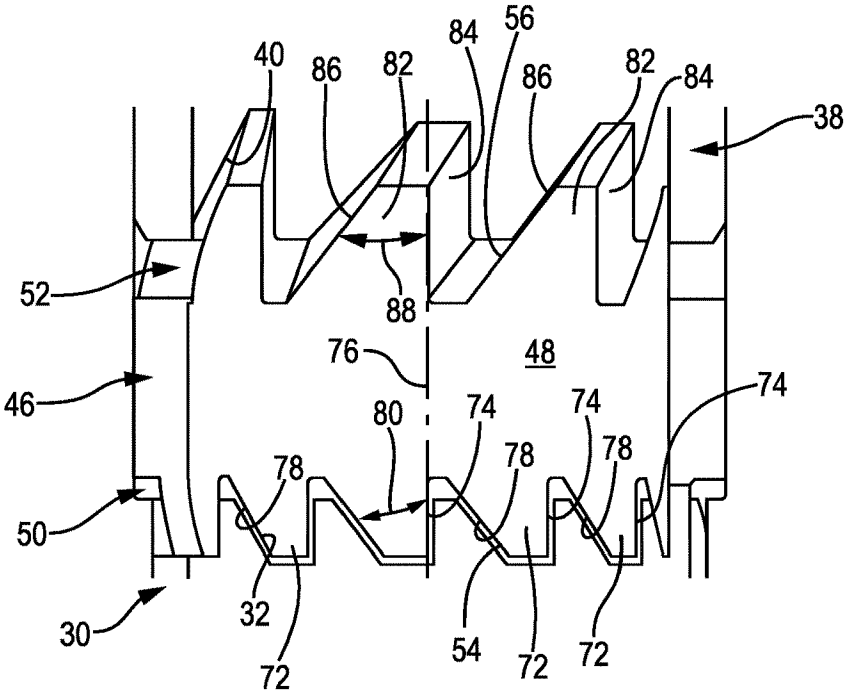
FIG. 3 is an enlarged illustration of the ratchet mechanism when positioned as shown in FIG. 2, according to an embodiment of the disclosure.

Referring generally to FIGS. 2 and 3, the ratchet mechanism 46 is illustrated as positioned to enable rotation of the casing hanger 26 in the first direction by the running tool 34. In this embodiment, the outer portion 44 of running tool 34 is releasably engaged with the casing hanger 26 via, for example, a threaded region 60 or other suitable engagement mechanism. According to this example, the outer portion 44 also may be engaged with the inner portion 42 via a threaded region 62 or via other suitable attachment mechanism.

Once the outer portion 44 and inner portion 42 are threadably engaged, they may be locked together in this threaded engagement via a retention mechanism 64. By way of example, the retention mechanism 64 may comprise a plurality of screws 66 effectively locking the outer portion 44 to the inner portion 42. Seals 68, 70 may be positioned between the inner portion 42 and outer portion 44 and between the outer portion 44 and the casing hanger 26, respectively. In the illustrated example, seal 68 is located on one side of ratchet mechanism 46; and seal 70 is located on the other side of ratchet mechanism 46.

With reference to FIG. 3, the lower cam profile 54 of ratchet mechanism 46 may be defined by a plurality of lower ratchet members 72, e.g. teeth. The lower ratchet members 72 may each have a first side 74 oriented in an axial direction generally parallel with an axis 76 extending longitudinally through the ratchet mechanism 46 as well as through the casing hanger 26 and running tool 34. Additionally, the lower ratchet member 72 may each have a second side 78 oriented at an angle 80 with respect to the axial direction and first side 74. By way of example, the angle 80 may be between 5° and 85°. However, in some embodiments, the angle 80 may be between 30° and 60°; between 25° and 45°; or within a suitable range of angles for a given environment and application.

Similarly, the upper cam profile 56 of ratchet mechanism 46 may be defined by a plurality of upper ratchet members 82, e.g. teeth. The upper ratchet members 82 may each have a first side 84 oriented in an axial direction which is generally parallel with the axis 76 extending longitudinally through the ratchet mechanism 46 as well as through the casing hanger 26 and running tool 34. Additionally, the upper ratchet member 82 may each have a second side 86 oriented at an angle 88 with respect to the axial direction and first side 84. By way of example, the angle 88 may be between 5° and 85°. However, in some embodiments, the angle 88 may be between 30° and 60°; between 25° and 45°; or within a suitable range of angles for a given environment and application. In some embodiments, the angles 80 and 88 may be the same, but in other embodiments the angles 80 and 88 may be different to achieve a desired operation of ratchet mechanism 46 in a given environment.

Referring again to FIGS. 2 and 3, the ratchet mechanism 46 is illustrated in a position which occurs during rotation of the casing hanger 26 by the running tool 34. As the running tool 34 rotates the casing hanger 26 in a first direction, the running tool cam profile 40 acts against the upper cam profile 56 in a manner which forces the ratchet mechanism 46 toward the casing hanger 26. In the illustrated example, the cam profile 40 has surfaces which act against the angled second sides 86 of upper ratchet members 82 to force the ratchet mechanism 46 in the illustrated downward direction.

This movement forces lower ratchet members 72 into engagement with the casing hanger cam profile 32. Specifically, the generally axial first sides 74 of lower ratchet members 72 are forced into abutting engagement with corresponding, axially oriented surfaces of the casing hanger cam profile 32. As a result, the casing hanger 26 becomes effectively locked with the running tool 34 via ratchet mechanism 46 such that casing hanger 26 rotates with running tool 34 in the first direction.

Figure 4:
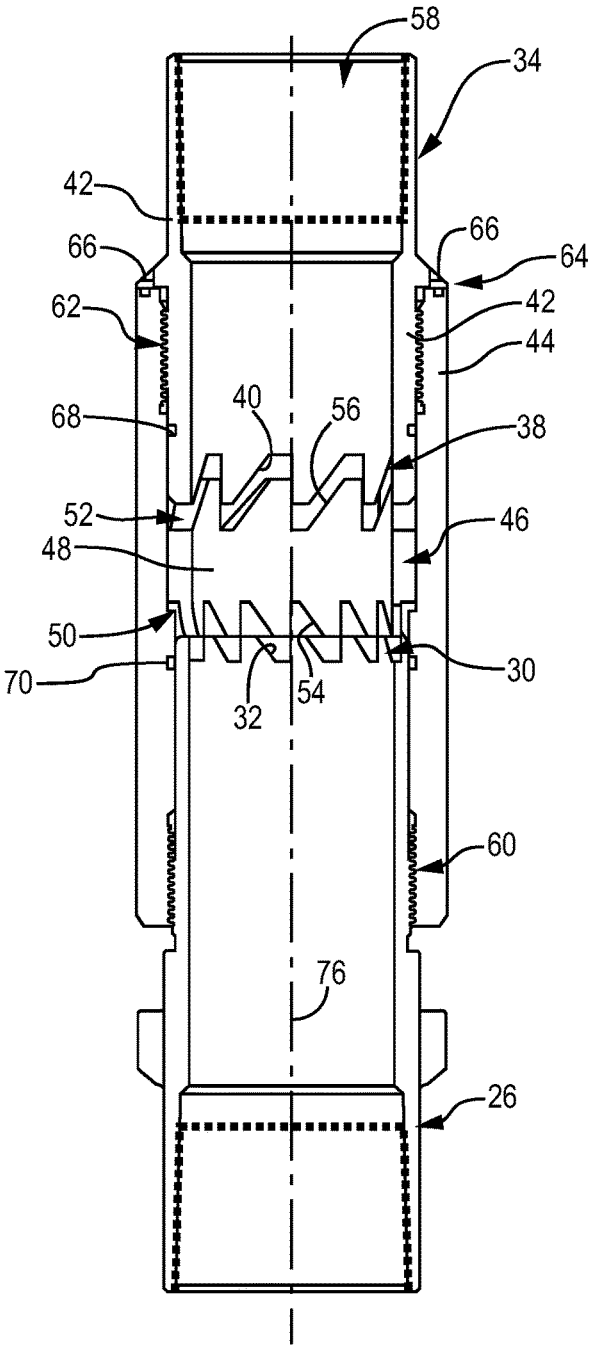
FIG. 4 is an illustration of an example of a ratchet mechanism positioned between a running tool and a casing hanger during rotation of the running tool to release the ratchet mechanism, according to an embodiment of the disclosure.
Figure 5:
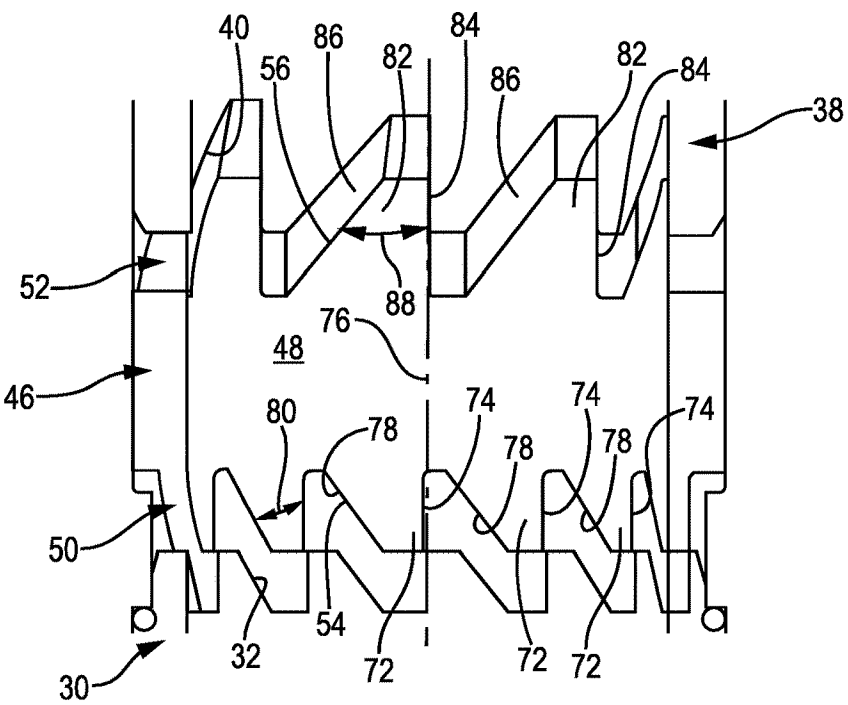
FIG. 5 is an enlarged illustration of the ratchet mechanism when positioned as shown in FIG. 4.

However, when the running tool 34 is rotated in a second or opposite direction, the ratchet mechanism 46 is shifted to a release position, as illustrated in FIGS. 4 and 5. As the running tool 34 is rotated in the second direction, generally axially oriented surfaces of running tool cam profile 40 engage the generally axially oriented first sides 84 of upper ratchet members 82. The initial rotation of running tool 34 in the second direction thus forces the angled second sides 78 of the lower ratchet member 72 against a corresponding, angled surfaces of the casing hanger cam profile 32.

Continued rotation of the running tool 34 in the second direction causes the angled second side 78 to slide upwardly along the corresponding, angled surfaces of casing hanger cam profile 32 until the ratchet mechanism 46 is released from casing hanger 26. To fully release the running tool 34 from the casing hanger 26, the running tool 34 is rotated in the second direction until fully unthreading the threaded region 60. Once the threaded region 60 is unthreaded and running tool 34 is released, the running tool 34 may be retrieved to, for example, a surface location. It should be noted the threaded region 60 enables the relative rotation between the running tool 34 and the casing hanger 26 as the ratchet mechanism 46 is shifted into and out of engagement with the casing hanger 26.

Figure 7:
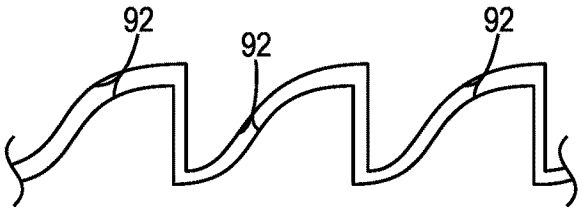
FIG. 7 is an illustration of another example of a ratchet mechanism cam profile, according to an embodiment of the disclosure.
Figure 6:
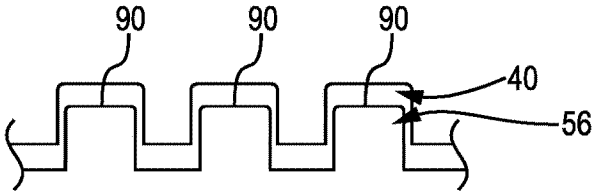
FIG. 6 is an illustration of another example of a ratchet mechanism cam profile, according to an embodiment of the disclosure.

Referring generally to FIGS. 6 and 7, additional examples of cam profiles are illustrated for use between the ratchet mechanism 46 and the corresponding components, e.g. running tool 34 and/or casing hanger 26. In FIG. 6, for example, the upper cam profile 56 may be formed with at least some of the upper ratchet members 82 having a generally rectangular shape 90. The running tool cam profile 40 may have a corresponding shape.

In other embodiments, the upper cam profile 56 and/or lower cam profile 54 may be constructed at least in part with a sinusoidal shape 92 or other suitable curvilinear shape to apply a desired downward force and/or release force on the ratchet mechanism 46. The running tool cam profile 40 and/or casing hanger cam profile 32 may be formed with a corresponding shape, e.g. an at least partially sinusoidal shape. FIGS. 6 and 7 are provided as examples of cam profiles which may be used to provide desired interactions and forces between the ratchet mechanism 46 and casing hanger 26/running tool 34 during rotation of the running tool 34 in the first direction or the second direction. However, other cam profiles may be employed to achieve the desired action of ratchet mechanism 46.

Depending on the specifics of a given well operation, the shape, size, and features of casing hanger 26, running tool 34, and ratchet mechanism 46 may be adjusted. For example, features of casing hanger 26 may have various shapes and sizes to accommodate different types of casing, other tubular members, and other equipment. Similarly, the running tool 34 may have various configurations and may be combined with various types of running tool strings for positioning the casing hanger 26 at the wellhead and/or at various other positions downhole. The ratchet mechanism 46 also may be constructed with various materials and may have various sizes and configurations. The upper and lower cam profiles may have similar or different configurations and may comprise ratchet members having various shapes, angles, curves, or other features to accommodate the desired interactions with the casing hanger 26 and the running tool 34. It should be noted use of the term "casing hanger" herein should not be construed as limiting with respect to types of applications. The casing hanger 26 may be used for hanging various types of casing and/or other types of tubular members, e.g. various types of tubing.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for use in a well, comprising:

a casing hanger;

a running tool releasably coupled with the casing hanger to enable deployment and rotation of the casing hanger in a borehole; and a ratchet mechanism positioned between the running tool and the casing hanger, the ratchet mechanism having a lower cam releasably engaged with the casing hanger, the lower cam having a lower cam profile which causes engagement with and rotation of the casing hanger when the running tool is rotated in a first direction and which causes the ratchet mechanism to release from the casing hanger when the running tool is rotated in a second direction, the ratchet mechanism further having an upper cam engaged with the running tool, the upper cam having an upper cam profile which forces the ratchet mechanism toward the casing hanger when the running tool is rotated in the first direction, wherein the running tool comprises an inner portion having a running tool cam profile oriented for engagement with the upper cam profile of the ratchet mechanism, the running tool further comprising an outer portion threadably engaged with the casing hanger along an exterior of the casing hanger.

2. The system as recited in claim 1, wherein the casing hanger is coupled with casing.

3. The system as recited in claim 1, wherein the inner portion and the outer portion are threadably engaged and then locked in threaded engagement.

4. The system as recited in claim 1, wherein the lower cam profile is defined by a plurality of lower ratchet members, each lower ratchet member having a first side oriented in an axial direction, which is generally parallel with a longitudinal axis of the ratchet mechanism, and a second side oriented at an angle of between 5° and 85° with respect to the axial direction.

5. The system as recited in claim 4, wherein the upper cam profile is defined by a plurality of upper ratchet members, each upper ratchet member having a first side oriented in an axial direction, which is generally parallel with the longitudinal axis of the ratchet mechanism, and a second side oriented at an angle of between 5° and 85° with respect to the axial direction.

6. The system as recited in claim 1, wherein the lower cam profile is defined by a plurality of lower ratchet members, each lower ratchet member having a first side oriented in an axial direction, which is generally parallel with a longitudinal axis of the ratchet mechanism, and a second side oriented at an angle of between 30° and 60° with respect to the axial direction.

7. The system as recited in claim 6, wherein the upper cam profile is defined by a plurality of upper ratchet members, each upper ratchet member having a first side oriented in an axial direction, which is generally parallel with the longitudinal axis of the ratchet mechanism, and a second side oriented at an angle of between 30° and 60° with respect to the axial direction.

8. The system as recited in claim 1, wherein the lower cam profile is at least partially sinusoidal.

9. The system as recited in claim 1, wherein the upper cam profile is at least partially sinusoidal.

10. A system, comprising:

a casing hanger;

a running tool having an inner tubular portion and an outer tubular portion rotatably coupled with the casing hanger along an exterior of the casing hanger; and a ratchet mechanism to facilitate both rotation of the casing hanger by the running tool and release of the running tool from the casing hanger, the ratchet mechanism being sized to fit within the outer tubular portion, the ratchet mechanism comprising:

a central body portion;

a lower cam extending from the central body portion and having a lower cam profile which causes engagement with and rotation of the casing hanger when the running tool is rotated in a first direction and which causes the ratchet mechanism to release from the casing hanger when the running tool is rotated in a second direction; and an upper cam extending from the central body portion opposite the lower cam and having an upper cam profile which forces the ratchet mechanism toward the casing hanger when the running tool is rotated in the first direction, wherein the inner tubular portion having a running tool cam profile is oriented for engagement with the upper cam profile.

11. The system as recited in claim 10, wherein the lower cam profile is defined by a plurality of lower ratchet members, each lower ratchet member having a first side oriented in an axial direction, which is generally parallel with a longitudinal axis of the ratchet mechanism, and a second side oriented at an angle of between 5° and 85° with respect to the axial direction.

12. The system as recited in claim 11, wherein the upper cam profile is defined by a plurality of upper ratchet members, each upper ratchet member having a first side oriented in an axial direction, which is generally parallel with the longitudinal axis of the ratchet mechanism, and a second side oriented at an angle of between 5° and 85° with respect to the axial direction.

13. The system as recited in claim 10, wherein the lower cam profile is defined by a plurality of lower ratchet members, each lower ratchet member having a first side oriented in an axial direction, which is generally parallel with a longitudinal axis of the ratchet mechanism, and a second side oriented at an angle of between 30° and 60° with respect to the axial direction.

14. The system as recited in claim 13, wherein the upper cam profile is defined by a plurality of upper ratchet members, each upper ratchet member having a first side oriented in an axial direction, which is generally parallel with the longitudinal axis of the ratchet mechanism, and a second side oriented at an angle of between 30° and 60° with respect to the axial direction.

15. The system as recited in claim 10, wherein at least one of the lower cam profile and the upper cam profile is at least partially sinusoidal.

16. A method, comprising:

positioning a ratchet mechanism between an inner portion of a running tool and a casing hanger and within an outer portion of the running tool;

rotatably coupling the running tool to the casing hanger along an exterior of the casing hanger via the outer portion;

conveying the casing hanger downhole into a borehole via the running tool;

using a first cam profile of the ratchet mechanism to drive a second cam profile of the ratchet mechanism into secure engagement with the casing hanger by rotating the running tool in a first direction, wherein the inner portion having a running tool cam profile is oriented for engagement with the first cam profile; and rotating the casing hanger in the borehole in the first direction.

17. The method as recited in claim 16, further comprising rotating the running tool in a second direction to cause the second cam profile to force the ratchet mechanism away from the casing hanger to a disengaged position.

18. The method as recited in claim 17, further comprising continuing rotation of the running tool in the second direction until the running tool is uncoupled from the casing hanger.

19. The method as recited in claim 16, further comprising forming each of the first cam profile and the second cam profile by providing the ratchet mechanism with a plurality of teeth each having an axially oriented surface and an angled surface.

* * * * *